United States Patent [19]

Schultes et al.

[11] Patent Number: 4,576,191

[45] Date of Patent: Mar. 18, 1986

[54] UMBRELLA FRAME

[75] Inventors: Tilmann Schultes; Joachim Seidel, both of Solingen, Fed. Rep. of Germany

[73] Assignee: Kortenback & Rauh KG, Soligen, Fed. Rep. of Germany

[21] Appl. No.: 672,893

[22] Filed: Nov. 19, 1984

[30] Foreign Application Priority Data

Dec. 23, 1983 [DE] Fed. Rep. of Germany ..... 3346672

[51] Int. Cl.[4] ..... A45B 25/00; A45B 25/18; A45B 25/08

[52] U.S. Cl. ..... 135/30; 135/36 R; 135/39

[58] Field of Search ..... 135/30, 29, 39, 31, 135/32, 33

[56] References Cited

U.S. PATENT DOCUMENTS

| | | | |
|---|---|---|---|
| 107,374 | 9/1870 | Hubbell | 135/30 |
| 364,987 | 6/1887 | Burnett | 135/30 |
| 496,504 | 5/1893 | Wylie | 135/29 |
| 537,805 | 4/1895 | Foulkrod | 135/29 |
| 653,164 | 7/1900 | Bedel | 135/30 |
| 778,765 | 12/1904 | Sprague | 135/30 |
| 958,341 | 5/1910 | Wetteroth | 135/20 |
| 1,240,645 | 9/1917 | Baker | 135/30 |
| 1,290,245 | 1/1919 | Kuehner | 135/30 |
| 2,604,898 | 7/1952 | Suel et al. | 135/30 |
| 4,201,237 | 5/1980 | Watts et al. | 135/30 X |

FOREIGN PATENT DOCUMENTS

| | | | |
|---|---|---|---|
| 251748 | 1/1927 | Italy | 135/30 |
| 10919 | of 1894 | United Kingdom | 135/30 |

*Primary Examiner*—Robert A. Hafer
*Assistant Examiner*—D. Neal Muir
*Attorney, Agent, or Firm*—Samuel Meerkreebs

[57] ABSTRACT

An umbrella frame has a pivotal connection between a crown or slider and canopy spokes or struts (1), respectively. The connection involves a sheet metal sleeve (3), which is carried on a stick (4) and has, integrally formed with it, an annular flange (5) and lobes (6). Each lobe comprises an axially extending inner section (6*a*) and an, initially outwardly extending, outer section (6*b*). During assembly, the outer sections are curled inwards about pivot pins(s) for the spokes or struts (1), which are seated in radius portions (R) at the junctions of the inner and outer lobe sections.

6 Claims, 7 Drawing Figures

UMBRELLA FRAME

BACKGROUND OF THE INVENTION

1. Field of the Invention

The invention relates to an umbrella frame, hereinafter referred to as of the kind described, comprising a stick carrying a crown and a slider, canopy spokes pivotally connected to the crown and struts pivotally connected to the slider; wherein at least one of the pivotal connections comprises a substantially cylindrical sheet metal sleeve which is carried by the stick, and which is provided at one end with a star-like array of radially outwardly projecting lobes, separated from one another by radial slits in which the inner ends of respective ones of the spokes or struts are hinged by means of at least one pivot pin which is located within inwardly curled portions of the lobes.

2. Description of Related Art

Umbrella frames of this kind, the hinges of which allow assembly by machine, are already known, for example, from the U.S. Pat. No. 958,341 to Wetteroth isued May 17, 1910, and U.S. Pat. No. 1,290,245 to Kuehner issued Jan. 7, 1919. For pivotally connecting the canopy spokes, in accordance with the U.S. Pat. No. 958,341 to Wetteroth an umbrella crown, which can be displaced along the stick of the umbrella by means of a cylindrical sleeve, is provided. Lobes are fashioned directly onto the sleeve to run radially outwards, in the form of a star transverse to the open end of the sleeve, and the number of lobes corresponds with the number of canopy spokes which have to be pivotally connected to the sleeve. The lobes are separated from one another by slits, in each of which a canopy spoke is hinged by means of an axle ring concentric with the sleeve and arranged at a radial clearance from the sleeve. This axle ring is attached to the sleeve by the lobes being curled round the axle ring so that they point inwards towards the axis of the sleeve.

For pivotally connecting the canopy spokes onto the crown of the umbrella frame, the ends are in the form of hooks which are hooked through the slits and round the axle ring. In order to avoid damage to an umbrella cover by any exposed sharp edges on the crown, the axle ring, with the ends of the canopy spokes hooked in, is encased from above by a protective cap. This protective cap is supported on a shoulder formed between the sleeve and the hinge lobes.

It is a disadvantage, in the case of this umbrella frame, that the assembly by machine of the umbrella hinges, canopy spokes and struts demands relatively complicated techniques. In order to be able to curl in the lobes round the axle ring, both the sleeve and the axle ring must be fixed in position concentrically be means of a tool. In particular, it is necessary to adjust the axle ring to be exactly concentric with the sleeve, since otherwise the whole umbrella frame geometry of the canopy spoke is incorrect upon hinging it onto the axle ring. Furthermore, it is a disadvantage that the lobes are fashioned directly onto the sleeve and that the dividing slits between the lobes are cut in right up to the sleeve. Forces arise, upon curling the lobes round the axle ring, which may easily lead to deformation of the sleeve so that it can no longer be mounted on the stick of the umbrella. Furthermore, the star formation of the lobes when curled round the axle ring is very easily damaged by bending. Even slight jerks, say, upon folding the umbrella or in the case of careless handling or dropping, may very easily deform it.

In the case of an umbrella frame in accordance with U.S. Pat. No. 1,290,245 to Keuhner, the lobes merge directly onto the surface of the sleeve. In this case as well, undesirable deformations of the sleeve upon curling in the lobes, or in the case of improper handling of the umbrella, cannot be avoided. Furthermore, the canopy spokes and struts, because of the proximity of their hinges to the sleeve, have insufficient play in their hinges to be able to rotate freely.

SUMMARY OF THE INVENTION

The problem underlying the invention is to develop further and to improve an umbrella frame of the kind described, in such a way that accurate assembly by machine of the umbrella canopy spokes and/or struts is possible without having to use complicated techniques, and that the risk of deformations of the sleeve, as well as of the hinges is avoided both in the assembly of the hinges and in the handling of the umbrella.

According to the present invention, such an umbrella frame is characterised in that the lobes extend from the outer edge of an annular flange which extends radially outwards from one end of the sleeve, and each of the lobes comprises an inner section connected to the flange and extending substantially axially of the sleeve at a position spaced from the sleeve, and an outer section positioned radially outwardly of the inner section to which it is connected via a radius portion corresponding substantially to the cross-sectional profile of the pivot pin; the free ends of the outer sections being curled inwardly to locate the pivot pin(s) resting in the radius portions.

An umbrella frame of this construction may have, with certainty, adequate radial clearance of the canopy spokes and/or struts from the sleeve, to provide sufficient play in the corresponding hinges. Also, the hinges are no longer formed by parts of the sleeve but exclusively by the lobes which are spaced by the annular flange from the sleeve, thus enabling the radius portion to be designed to correspond substantially to the cross-sectional profile of the pivot pin.

A particular advantage arises in the assembly of the umbrella frame as the or each pin may be nested in its corresponding radius portions, whilst the outer lobe sections are projecting in substantially radially outward directions, and the outer lobe sections are then curled inwardly round the pin(s) substantially without causing disturbance to the radius portions.

Undesirable deformations of the sleeve or the hinges upon curling in the lobes or during later handling of the umbrella frame may therefore be avoided. In particular, the radial clearance of the pivot pin(s), which may be formed by a common axle ring or by pins individual to the spokes or struts, from the centreline of the sleeve is already predetermined by the radius portion between the two sections of the lobes, and hence is unalterable. Before the curling in of the lobes the pivot pins merely need to be nested in their corresponding radius portions. After that the ends of the outer section of the lobes only need to be curled round the pins towards the axis of the sleeve in order to finish producing the whole annular hinge. When nesting the pins in their radius portions, their concenric positions are accurately established by the radius portions. Special measures and tools for concentric adjustment and fixing of the parts which are to be pivotally connected are therefore not necessary.

Deflection of the pivot pins because of the action of forces during the curling-round is not possible. The action of possible forces upon the lobes during curling-round, or of forces upon the finished hinges in the case of rough handling of the umbrella frame, is not transmitted to the sleeve but is taken up by the annular flange and absorbed in it. Hence the sleeve remains protected against shock and does not become deformed out of its cylindrical shape, and can consequently be mounted accurately upon the umbrella stick and, in the case of a slider, slid up and down it.

Particularly when the pivotal connection is between crown and canopy spokes, it is useful if the inner section of the lobe, the annular flange and the sleeve form, in axial section, a U-profile. The annular flange thereby forms a hat-shaped termination which imparts great rigidity and at the same time provides a stop for a tip which may possibly be mounted on it for centreing the umbrella cover.

DESCRIPTION OF PREFERRED EMBODIMENTS

Furthermore, the U-shaped transition from sleeve to hinges shields the hinges and has effect that the canopy lying next to or sliding over the U-shaped transition cannot be damaged by the hinges, even though there is an increase in the diameter of the annular hinge. A special protective cap is therefore superfluous.

Particularly when the pivotal connection is between slider and struts, it is useful if the inner section of the lobe, the annular flange and the sleeve form, in axial section, substantially a Z-profile. The sleeve unit may be easily combined with a cylindrical handle portion into a composite slider. Thus the sleeve may form a hinge-headpiece of a composite slider and is plugged into a handle portion of the slider.

The sleeve may be provided with deformable retainer-lobe for attachment to the handle portion or to the stick of the umbrella.

Examples of umbrella frames constructed in accordance with the invention are illustrated in the accompanying drawings, in which.

Figure 2:
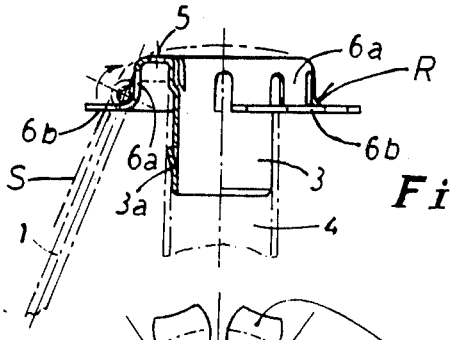
FIG. 2 is a half-sectioned side elevation of FIG. 1.
Figure 1:
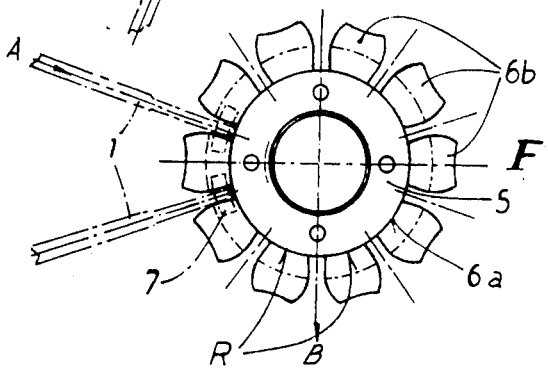
FIG. 1 is a plan of a crown part of a frame.

For the hinging of canopy spokes 1 or struts 2 of an umbrella frame, which is not illustrated in greater detail, there is a cylindrical sleeve 3 which is carried by a stick 4. This sleeve 3, in the case of employment as an umbrella crown in accordance with FIGS. 1 and 2, is fixed over the top end of the umbrella stick 4 or, as is indicated in FIG. 2 in dash-dot line, is plugged into the cavity in the umbrella stick 4. In the case of employment as an umbrella slider in accordance with FIGS. 3 and 4, the sleeve 3 serves for the guidance, along the umbrella stick 4, of this slider together with the canopy-supporting framework which is arranged on it to be able to fold as the slider slides up and down the umbrella stick, thus opening and closing the canopy.

In either case an annular flange 5 is fashioned onto the top end of the cylindrical sleeve 3 to stand out approximately at right angles. From the outer edge of the annular flange 5 a number of lobes 6 are stamped out to correspond with the number of canopy spokes 1 or struts 2 which are to be hinged onto it. The lobes 6 are bent at an angle and have two sections, **6*a* and 6*b*. The inner sections 6*a* of the lobes 6, fashioned at an angle to the annular flange 5, run approximately in parallel with and at a clearance from the surface of the sleeve 3. The outer sections 6*b* of the lobes 6, in their initial state, stand out in the radial direction approximately at right angles from the inner sections 6*a* and at their free ends can be curled in the direction of the inner sections 6*a* to form hinge bushes (FIGS. 2 and 4**).

An umbrella crown, in accordance with FIGS. 1 and 2, has the inner sections **6*a* of the lobes 6 running in parallel with and adjacent to the sleeve 3. In this way the sections 6*a*, the annular flange 5 and the sleeve 3 form a hollow U-shaped transition which may be seen from FIG. 2** and which shields the hinges.

Figure 4:
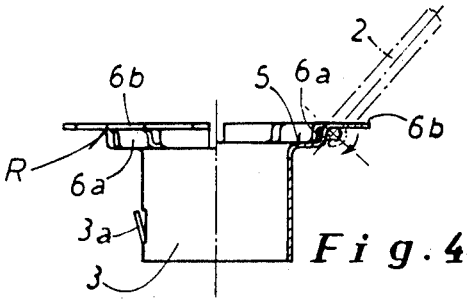
FIG. 4 is a half-sectioned side elevation of FIG. 3.
Figure 3:
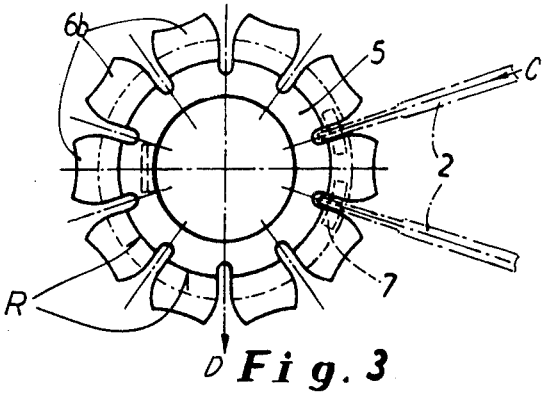
FIG. 3 is a plan of a slider part of a frame.

An umbrella slider in accordance with FIGS. 3 and 4, has the inner sections **6*a* bent down from the annular flange 5 at right angles and in parallel with the sleeve 3, yet not adjacent to it but pointing away from it. Then from the inner sections 6*a* of the lobes 6, the outer sections 6*b* are bent at right angles to stand radially outwards so that the sections 6*a*, the annular flange 5 and the sleeve 3** form a profile which, in section, is approximately a Z.

In both examples, the sections **6*a* and 6*b* of the lobes 6 continue into one another via a curve R. The radius of this curve R corresponds substantially to the cross-sectional profile of the pivot pin 7,8 which serves to support one canopy spoke 1 or strut 2 between every two adjacent lobes 6. The curves R of the sections 6*a*,6*b* form preformed radius portions of an annular bearing seat for the pivot pins 7 or 8 and hence also make possible accurate adjustment and fixing which remains unaltered and thus undeformed during curling-in of the ends of the outer sections 6*b*. This ensures the required alignment and hinging of the framework with respect to the umbrella stick 4. Hence, the pivot pins 7 or 8 merely need to be nested in the radius portion R and they are then precisely fixed by bending round the free ends of the outer lobe sections 6*b*; all this may be done without special accesories and precautions for concentric adjustment. Since the bending round of the ends of the outer sections 6*b* is towards the axis of the sleeve 3, the pivot pins 7 or 8 cannot move out of the radius portions R. This not only simplifies the assembly of umbrella frames by machine but also forms particularly rigid hinge connections. Not only are the effects of the forces upon the sleeve 3 and upon the lobes 6, which arise during the bending round of the ends of the outer sections 6*b*, taken up by the annular flange 5** and absorbed in it, but also those forces which arise through improper use of the umbrella.

Finally, the construction of the umbrella frame in accordance with the present invention also makes it possible that, in spite of the arrangement of the canopy spokes or struts 1, 2 at a distance from the umbrella stick 4 and in spite of the increase in the diameter of the annular hinge, the hinges are such that the umbrella cover S may, without risk of damage, rest against the hinges and slide over them. An enclosure covering over the hinges or protecting the umbrella cover is therefore superfluous.

Figure 5:
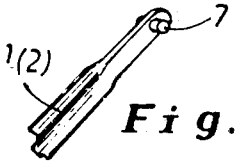
FIG. 5 is a perspective view of the radially inner end of a canopy spoke or a strut having a straight pivot pin.
Figure 6:
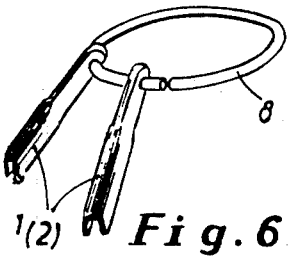
FIG. 6 is a perspective view of canopy spokes or struts on an axle ring; and, FIG. 7 is an elevation of an umbrella slider composed of a handle portion and a sleeve unit in accordance with FIGS. 3 and 4.

As may be seen from FIG. 5, the pivot pins may consist of pegs 7 which are fitted at the ends of the canopy spokes 1 or struts 2, which are to be hinged. The pegs 7 may b arranged or else fashioned onto the canopy spokes 1 or struts 2 so as to be able or unable to rotate. The pivot pins or pegs 7 may also be arranged or fashioned onto the crown or slider itself. Finally the pivot pins or pegs 7 may be curved so as to follow the annular run of the radius portions R or replaced by a single axle ring 8, corresponding with FIGS. 3 and 6 respectively.

As may be seen from the sectional illustrations in FIGS. 2 and 4, the bearing surfaces of the hinges for the pivot pins 7, 8 are approximately half formed by a region of the inner section 6*a* and half formed by the outer section 6*b* with the fixed bearing seat in the form of the radius sections R lying between them. Of these, as already stated, the inner sections 6*a* and the radius portions R remain unaltered in their preformed shape during the wrapping of the pivot pins 7, 8. It is merely the free ends of the outer sections 6*b* which are bent round the pivot pins in the direction of the inner sections 6*a*, that is, preferably until their ends butt against the inner sections 6*a*. The whole of the concentric adjustment and alignment of the bearing part in accordance with the invention, and the associated mechanics of the canopy, is therefore also guaranteed during the bending round of the ends of the outer sections 6*b* and after this process.

Figure 7:
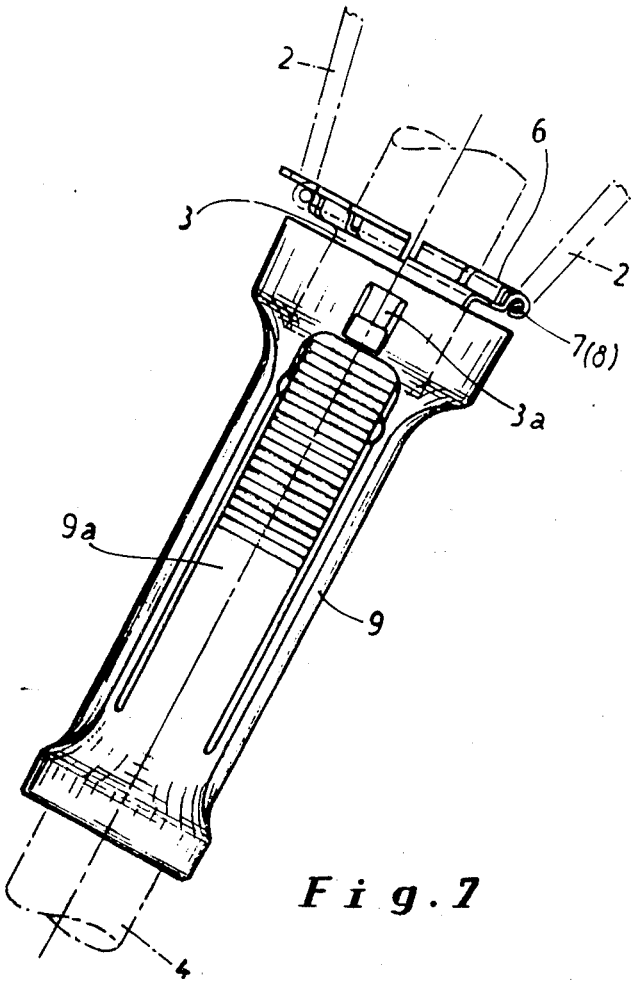

In FIG. 7, a combination is shown of the slider in accordance with FIGS. 3 and 4 with a plastic sleeve 9. This combination yields a composite slider which has large area for seizing it and a button 9*a* by means of which the slider may be locked to the umbrella stick in its operational positions, and released. In the case of this composite slider, the plastic sleeve 9 forms the grip and the slider, shaped out of sheet metal, provides the hinges for the struts 2. The slider may be plugged, by means of the sleeve 3, into the grip or plastic sleeve 9, and may be fixed in it by a resilient hook or lobe 3*a*. This hook or lobe 3*a* may be bent out from the wall of the sleeve 3 and snap into a recess in the plastics sleeve 9. By this means combination sliders of different lengths, different appearance and different internal diameters with respect to different diameters of umbrella sticks 4 may be realized whilst employing the same slider for hinging the struts 2.

We claim:

1. In an umbrella frame comprising a stick, a crown and a slider, a first pivotal connection of a plurality spokes to said crown, a second pivotal connection of a plurality of struts to said slider, at least one of said first and second pivotal connections comprising a substantially cylindrical sheet metal sleeve carried by said stick and provided at one end with a star-like array of radially outwardly projecting, inwardly curled lobes, said lobes having edge means defining slits therebetween, members constituted by one of said plurality of canopy spokes and struts hinged at inner ends thereof in respective ones of said slits by means of at least one pivot pin located within said inwardly curled lobes; the improvement comprising a single, one-piece element including an annular flange extending radially outwards from said one sleeve end; each of said lobes comprising an inner section connected to said flange and being of a greater length than the cross section of said one pivot pin and extending substantially axially of said sleeve at a location spaced from said sleeve, and an outer section positioned outwardly of said inner section prior to assembly and connected thereto via a radius portion corresponding substantially to a cross section profile of the pivot pin, free ends of said outer lobe sections being permanently curled inwardly to locate said at least one pivot pin resting in said radius portions, said curled lobe outer sections having a free outer edge disposed substantially adjacent to said inner section and spaced from and confronting the outer surface of said inner section.

2. An umbrella frame according to claim 1, wherein said inner lobe section, said annular flange, and said sleeve form, in axial section, a U-profile.

3. An umbrella frame according to claim 1, wherein said inner lobe section, said annular flange, and said sleeve form, in axial section, a substantially Z-profile.

4. An umbrella frame according to claim 3, incorporating a composite slider, said composite slider comprising a hinge-headpiece formed by said sleeve, and a handle portion, said sleeve being plugged into said handle portion.

5. An umbrella frame according to claim 1, wherein said sleeve is provided with a deformable retainer-lobe adapted for attachment to a member taken from the group consisting of said stick and a handle portion of said slider.

6. The method of assemblying an umbrella frame with a consistently defined geometry in which said frame includes a stick, at least one crown and a slider carried by said stick, pivotal connections between spokes to said crown and struts to said slider, respectively, at least one of said pivotal connections comprising a one piece cylindrical metal sleeve carried by said stick at the end of a star-like array of radially projecting, bent lobes defined by radial slits between said lobes, at least one of said spokes and struts being pivotally connected to said bent lobes by pivot means; the improvement comprising the steps of:

A. forming a one-piece element with a radial, outwardly extending flange from said sleeve;

B. forming each of said lobes with an inner section connected to said flange and having a length greater than the cross-section of said pivot means and extending in axially-spaced relation from said sleeve, and an outer section, integral with said inner section and projecting radially therefrom and forming therewith a positioning-radius at the intersection between said inner and outer sections and substantially corresponding to a cross sectional profile of said pivot means;

C. orienting said pivot means in said positioning-radius; and

D. permanently bending the outer section of said lobe toward said positioning-radius and forming a pivot sleeve about said pivot means in spaced relation from said sleeve and with a free outer edge disposed substantially adjacent to said inner section and spaced from and confronting the outer surface of said inner section.

* * * * *